United States Patent [19]

Sabino

[11] 4,345,519

[45] Aug. 24, 1982

[54] VERTICAL CAN CRUSHER

[76] Inventor: Mario C. Sabino, R.R. #1, Hennepin, Ill. 61327

[21] Appl. No.: 239,041

[22] Filed: Feb. 27, 1981

[51] Int. Cl.[3] ..... B30B 15/30; B30B 9/32

[52] U.S. Cl. ..... 100/215; 100/218; 100/229 R; 100/257; 100/288; 100/902

[58] Field of Search ..... 100/902, 218, 288, 215, 100/257, 240, 246, 229 R, 221, 224; 99/580, 581, 582; 241/99

[56] References Cited

U.S. PATENT DOCUMENTS

| | | | |
|---|---|---|---|
| 2,069,877 | 2/1937 | Fix | 99/582 X |
| 2,563,379 | 8/1951 | Smith | 100/902 |
| 2,638,957 | 5/1953 | Danielson | 100/902 |
| 3,009,414 | 8/1958 | Griemert | 100/293 |
| 3,040,656 | 6/1962 | Du Waldt | 100/288 |
| 3,159,098 | 12/1964 | Dedekam | 100/218 X |
| 3,889,587 | 6/1975 | Wharton | 100/98 |
| 4,088,072 | 5/1978 | Wittmeier | 100/902 |
| 4,168,661 | 9/1979 | Wigdahl | 100/902 X |
| 4,228,734 | 10/1980 | Parrish | 100/245 |

FOREIGN PATENT DOCUMENTS

| | | | |
|---|---|---|---|
| 76773 | 2/1918 | Switzerland | 100/229 R |

*Primary Examiner*—Billy J. Wilhite

*Attorney, Agent, or Firm*—Hill, Van Santen, Steadman, Chiara & Simpson

[57] ABSTRACT

A vertical can crusher of the type having a vertical standard carrying a cantilever head supporting a vertically movable crushing ram, and means for vertically actuating the ram reciprocatably relative to an upwardly facing worktable substantially spaced below the head and fixed relative to the standard, and comprising a vertical tubular can receptacle having its lower end separably supported on the work table and having its upper end open to receive a can therein and adapted to receive the ram for crushing the can against the worktable. Horizontal means attached to the receptacle and guided by the standard controls the receptacle for movement relative to the standard and the head between a first position operatively aligned under the ram so that a can placed in the receptacle is adapted to be crushed by the ram into a flattened disk, and a second position adapted for discharging the crushed can disk from the receptacle. A third position of the receptacle supported at its lower end on the worktable at a location intermediate the first and second positions adapts the receptacle for loading thereinto a can to be crushed.

12 Claims, 6 Drawing Figures

FIG. 1
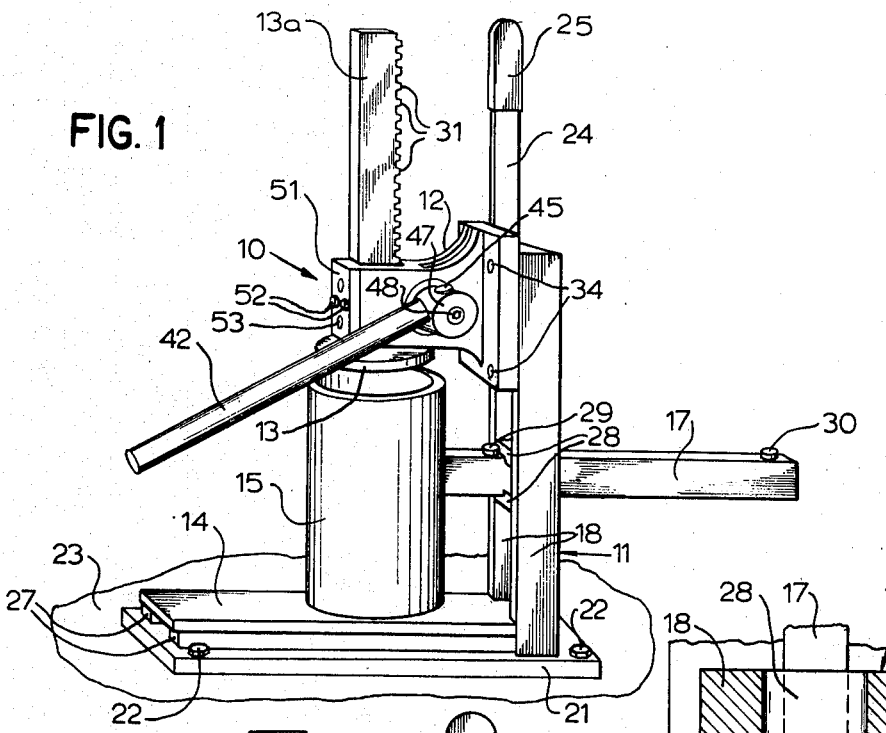
FIG. 3
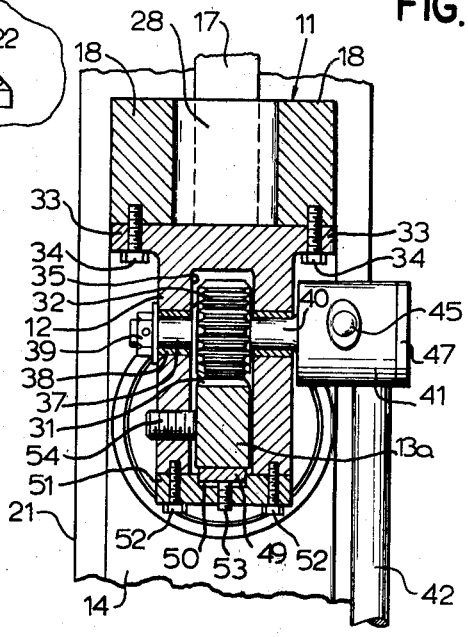
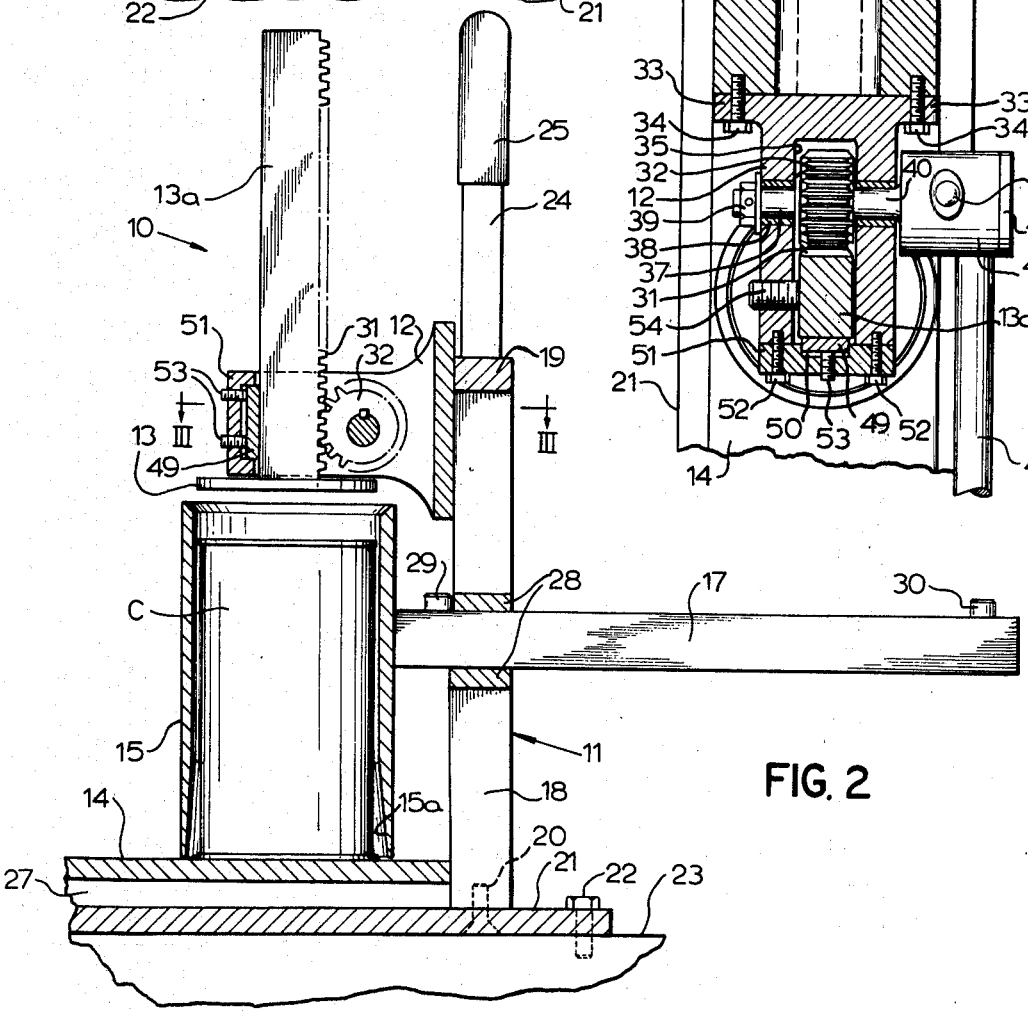
FIG. 2

VERTICAL CAN CRUSHER

This invention relates to vertical can crushers of the type having a vertically movable crushing ram and means for actuating the ram reciprocably relative to a worktable and fixed relative to the ram, and is more particularly concerned with such a device having new and improved means to facilitate handling a can for crushing and for discharging the crushed can.

Numerous and varied can crushers have been proposed heretofore, and I am aware of the following U.S. Pat. Nos. disclosing such crushers of the vertical type:

2,563,379—8/1951—discloses a vertical crushing ram operated by a lever and link arrangement, but provides no means for discharging the crushed can.

2,638,957—5/1953—discloses a vertical plunger driven by rack and pinion means, but provides no means for discharging the crushed can.

3,009,414—11/1961—provides a lever and link drive for for the crushing plunger, but has no means discharging the crushed can.

3,889,587—6/1975—discloses a rack and pinion plunger for crushing the can within a pivotally mounted guide sleeve which is pivotal with the plunger device relative to a base for discharging the crushed can.

4,088,072—5/1978—provides a handle and lever arrangement for driving can crushing jaw means but has no means for discharging the crushed can.

4,228,734—10/1980—provides a handle and toggle arrangement for driving the can pressing plunger, but has no means for discharging the crushed can.

After a can has been crushed in a can crushing device, the crushed can should be removed to make room for additional can to be crushed. Of the above noted patents, only U.S. Pat. No. 3,889,587 has an arrangement to facilitate discharge of a crushed can, in which the tubular sleeve or guide for the can to be crushed must be pivoted together with the entire plunger device relative to the anvil or crushing table and then the sleeve and plunger must be swung back over the table whereafter the plunger must be retracted and swung on a pivotal arrangement out of obstructing relation to the sleeve so that another can to be crushed can be loaded into the sleeve.

An important object of the present invention is to provide a new and improved can crusher which is simple, rugged and compact in structure, and which provides a new and improved arrangement to facilitate loading a can to be crushed, crushing the can and discharging the crushed can.

Pursuant to the invention, there is provided in a vertical can crusher of the type having a vertical standard carrying a cantilever head supporting a vertically movable crushing ram, and means for vertically actuating the ram reciprocatably relative to an upwardly facing worktable substantially spaced below the head and fixed relative to the standard, the improvement comprising a vertical tubular can receptacle having its lower end separably supported on the worktable and having its upper end open to receive a can therein and adapted to receive the ram for crushing the can, and horizontal means attached to the receptacle and guided by the standard for controlling the receptacle for movement relative to the standard and the head between a first position operatively aligned under the ram so that a can placed in the receptacle is adapted to be crushed into a flattened disk by operating the actuating means to drive the ram downwardly into the receptacle, followed by reversing the ram from the receptacle, and a second position adapted for discharging the crushed can disk from the receptacle clear of the worktable. The horizontal means is also adapted for controlling movement of the receptacle into a third position with its lower end supported on the worktable and at a location intermediate the first and second positions and adapted for loading into the receptacle a can to be crushed.

Other objects, features and advantages of the invention will be readily apparent from the following description of a certain representative embodiment thereof, taken in conjunction with the accompanying drawing although variations and modifications may be effected without departing from the spirit and scope of the novel concepts embodied in the disclosure and in which:

FIG. 1 is a perspective view of a can crusher embodying the invention;

FIG. 2 is a vertical sectional detail view through the crusher of FIG. 1;

FIG. 3 is a horizontal sectional detail view taken substantially along the line III—III of FIG. 2;

Figure 4:
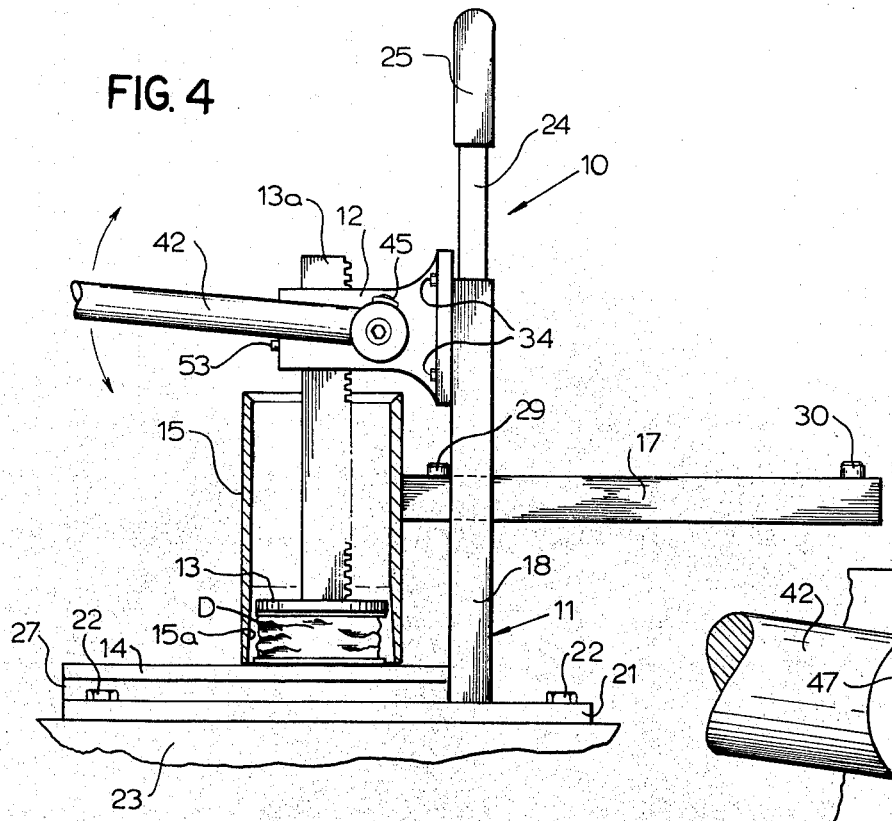
FIG. 4 is a view similar to FIG. 2 but showing the can crushing ram at the end of a crushing stroke.

A vertical can crusher 10 embodying the present invention has a vertical standard 11 carrying a cantilever head 12 reciprocatably supporting a vertically movable crushing ram 13 over an upwardly facing worktable 14 substantially spaced below the head 12 and fixed relative to the standard 11.

Of particular significance to the present invention is the provision of a vertical tubular can receptacle 15 having its lower end separably supported on the worktable 14 and having its upper end open to receive a can therein and adapted to receive the ram for crushing the can. Horizontal means in the form of an elongate bar 17 connected to the receptacle 14 is guided by the standard 11 for controlling the receptacle for movement relative to the standard 11 and the head 12 between a first position (FIGS. 1 and 2) operatively aligned under the ram 13 so that a can C placed in the receptacle 15 is adapted to be crushed into a flattened slug or disk D (FIG. 4) by operating actuating means comprising a rack **13*a* to drive the ram 13 downward into the receptacle 15, followed by retraction of the ram from the receptacle (FIG. 5), and a second position adapted for discharging the crushed can from the receptacle clear of the worktable 14. By having the lower end portion of the receptacle 15 flared as shown at 15*a*, jamming of the disk D is avoided. The bar 17 is adapted to guide the receptacle 15 into a third position with its lower end supported on the worktable 14 and at a location (phantom outline in FIG. 5**) intermediate the first and second positions and adapted for loading a can C to be crushed into the receptacle.

In a desirable construction, the standard 11 comprises a rugged vertical frame having spaced parallel upright bars 18 rigidly connected together at their upper ends by a spacer 19 and secured at their lower ends as by means of bolts 20 to a base plate 21 adapted to be attached as by means of bolts 22 to a supporting structure 23 which may be a table, stand, or the like. Projecting upwardly above the top of the standard may be a rigid upright handle 24 having a suitable hand grip 25 and which may be employed as a steadying handhold to be grasped by one hand of the user while manipulating the crushing ram with the other hand. The handle 24 may also be useful for transporting the crusher 10 as a portable device, and for steadying the crusher where it is merely set down upon the supporting structure 23 without being bolted thereto. Although the base plate 21 may serve as the worktable 14, in the preferred arrangement, the worktable 14 comprises a separate plate supported by spacer means comprising a pair of spaced parallel front to rear runner bars 27 secured to the plates 14 and 21. The combined thickness of the plate 14 and the spacers 27 is desirably greater than the thickness of the crushed can slug or disk D so that after the same has dropped from the receptacle 15, the lower end of the receptacle 15 will clear the discharged disk for return from the discharge position to the loading position.

Figure 5:
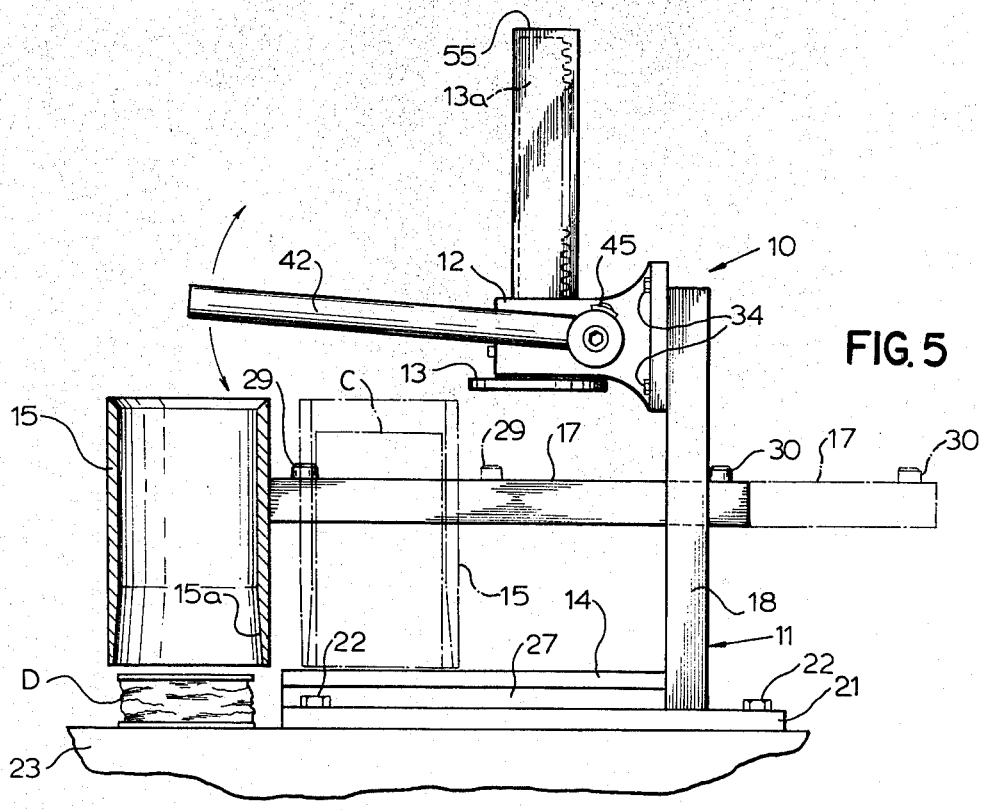
FIG. 5 is a view similar to FIG. 2 but showing the can guiding receptacle in the can discharging position as well as in a can loading position, and a different upright handle is provided.

In keeping with its receptacle-guiding function, the guide bar 17 is fixedly secured to the receptacle 15 and projects rearwardly therefrom and extends through a guideway provided by and between horizontal guide members 28 fixed to and between the bars 18 of the standard 11. A freely longitudinally slidable engagement of the guide bar 17 in the guideway 28 is provided for. Through this arrangement, the receptacle 15 is adapted to be readily shifted horizontally between the can crushing position, the discharging or unloading position and the loading position by simply manually rectilinearly pulling or pushing the same, using the receptacle as a handle. In order to index the receptacle 15 in the can crushing coaxial alignment with the plunger 13, the guide bar 17 has stop means in the form of a stud 29 properly located adjacently spaced from the receptacle 15 for stopping engagement with the guide 28 (FIG. 2) when the receptacle 15 has been pushed rearwardly into the can crushing position. A limit stop in the form of a stud 30 adjacent to the rear or free end of the guide bar 17 is adapted to engage the guide means 28 for indexing the receptacle 15 in the fully forwardly pulled can disk unloading position (FIG. 5).

In a preferred arrangement, the device 13*a* for actuating the can crushing ram 13 comprises a plunger bar which projects upwardly from the ram 13 through, and is guided by, the head 12 and has along its vertical rear edge rack teeth 31 which mesh with complementary teeth on a pinion 32 mounted in the head 12. As best seen in FIGS. 2 and 3, the head 12 comprises a forwardly projecting head block member which has laterally projecting and rearwardly facing base flanges 33 secured as by means of bolts 34 to the bars 18 of the standard 11. A vertical upwardly and downwardly and forwardly opening slot 35 in the head member 12 accommodates the plunger bar 13*a* in the forward part of the slot and the driving pinion 32 in the rearward portion of the slot. A driveshaft 37 extends through and is keyed to the pinion 32 and has one end portion projecting through a bearing bushing 38 in one wall defining the slot 35 and on its outer end portion carries a fixed but removable retaining collar 39. The opposite end portion of the shaft 37 extends rotatably through a bearing bushing 40 in the opposite wall of the head defining the slot 35 and has connected thereto a hub 41 of an operating handle 42 which projects radially from the hub and is adapted to be manipulated for driving the ram 13 in can crushing and return strokes. Can crushing efficiency is attained by generating crushing strokes of 500 to 1000 pounds of the ram 13.

Figure 6:
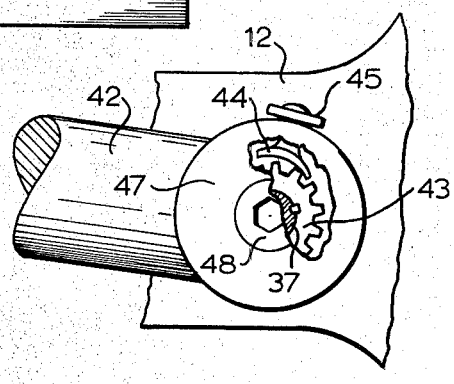
FIG. 6 is an enlarged fragmentary side elevational view of the operating handle hub, partially broken away to reveal internal details.

Although the handle hub 41 may be fixedly secured to the shaft 37, in a preferred arrangement a reversible pawl and ratchet connection is provided for selectively connecting the hub 41 to the shaft 37 for selectively driving the pinion 32 in either rotary direction. To this end, as shown by way of example in FIGS. 3 and 6, the hub 41 is hollow and accommodates a ratchet wheel 43 which is keyed to the shaft 37. A selectively shiftable double-acting pawl 44 is mounted within the hub and is controllable by a digitally operable member 45 on the outside of the hub 41 for selectively shifting the pawl 44 relative to the ratchet wheel 43 for driving the shaft 37 either clockwise or counterclockwise as viewed in FIG. 6. For driving the pinion 32 clockwise and raising the plunger rack bar 13*a* when the handle 42 is pumped, as indicated by directional arrows in FIG. 4, the pawl 44 has its rear end depressed to engage the ratchet wheel 43. When it is desired to lower the plunger bar 13*a* and the ram 13 for crushing a can in the receptacle 15, the pawl 44 is reversed to depress its forward end for driving the ratchet wheel 43 in counterclockwise direction as viewed in FIG. 6 by pumping the handle 42. Means for retaining the hub 41 on the shaft 37 comprise a retainer disk 47 secured as by means of a screw 48 to the adjacent outer end of the shaft.

Adjustable friction clutch means are provided for imposing sufficient resistance against independent travel or slippage of the plunger rack bar 13*a*. For this purpose, a backlash pressure pad 49 (FIGS. 2 and 3) is mounted in an inwardly facing recess 50 in a closure plate 51 secured to the forward end of the head 12 across the forward opening of the slot 35, means such as screws 52 securing the plate 51 in place. Adjustment set screws 53 thrust the pad 49 into frictional, slidable engagement with the forwardly facing vertical edge of the bar 13*a*, substantially in line with the driving pinion 32. In addition, a friction set screw 54 may be threadedly engaged in one of the walls of the head 12 defining the slot 35, with the inner end of the friction screw 54 adjustably pressing the bar 13*a* toward the opposite wall of the head 12. By proper adjustment of the screws 53 and 54, not only is backlash of the bar 13*a* avoided, but the desired frictional resistance to independent movement or vertical slippage of the bar achieved. Thereby, in the pumping driving actions of the handle 42, the bar 13*a* is held steadily and against backlash or movement in reverse to the direction in which it is desired to advance the bar 13*a* by action of the pawl 44 acting on the rack gear 43.

From the foregoing, it will be apparent that the invention provides a compact, rugged, simple can crusher in which the can crushing ram 13 need be raised only sufficiently to just clear the top of the can receptacle 15 so that the range of movement of the ram is minimized between the fully raised receptacle clearing position and the fully depressed can crushing position of the ram. This desirably limits the height of overhead clearance needed for accommodating the crusher 10. The width of the crusher need be only enough to accommodate the relatively narrow worktable 14 and stable base plate 21. The length of the worktable 14 need only be sufficient to accommodate the can crushing position of the receptacle 15 and the loading position thereof just barely clear of the crushing ram 13. Rearward clearance is needed only to accommodate maximum rearward projection of the receptacle guide bar 17.

Instead of the handle 24, the device 10 may, in a presently preferred embodiment, be provided with an upstanding rigidly mounted tubular guard or sheath 55 projecting upwardly from the head 12 and functioning not only to enclose the rack bar plunger 13*a* in its raised position but also serving as a steadying or stabilizing or otherwise advantageous handle (FIG. 5).

Standard size cans of about 12 oz. capacity generally constitute the bulk of cans requiring disposal and the device as shown may be considered equipped for handling that size of cans for crushing. However, if larger capacity, and thus longer, cans must be accommodated, it is a simple matter to raise the standard 11 adjustably and thus the clearance of the lower end of the receptacle relative to the table 14. This can be done, for example, by releasing the screws 20 and inserting and securing suitable spacer means to and between the lower ends of the bars 18 and the base 21.

While for certain parts, bolted or screwed securement has been indicated, it will be appreciated that any preferred means for securing parts together may be adopted, and welding securement may be understood, where no other specific means of securement has been indicated.

It will be understood that variations and modifications may be effected without departing from the spirit and scope of the novel concepts of this invention.

I claim as my invention:

1. In a vertical can crusher of the type having a vertical standard carrying a cantilever head supporting a vertically movable crushing ram, and means for vertically actuating the ram reciprocatably relative to an upwardly facing worktable substantially spaced below said head and fixed relative to the standard, the improvement comprising:

a vertical tubular can receptacle having its lower end separably supported on said worktable and having its upper end open to receive a can therein and adapted to receive said ram for crushing the can against said worktable;

and horizontal means attached to said receptacle and guided by said standard for controlling said receptacle for movement relative to said standard and said head between:

a first position operatively aligned under said ram so that a can placed in said receptacle is adapted to be crushed into a flattened disk by operating said actuating means to drive the ram downwardly into the receptacle, followed by raising of the ram from said receptacle, and a second position adapted for discharging the crushed can from the receptacle clear of said worktable.

2. A can crusher according to claim 1, wherein said horizontal means is adapted for controlling movement of said receptacle into a third position, with the lower end of the receptacle being open and supported on said worktable, and at a location intermediate said first and second positions and adapted for loading a can to be crushed through said upper open end into the receptacle.

3. A can crusher according to claim 1, wherein said horizontal means comprises a bar, means on said standard for guiding said bar for rectilinear movement, and spaced stop means on said bar cooperating with means on said standard for indexing said first and second positions of said receptacle.

4. A can crusher according to claim 1, including an upwardly projecting fixed handle on said standard.

5. A can crusher according to claim 1, wherein said means for actuating the ram comprises an upwardly projecting rack bar plunger on said ram, said rack bar plunger extending upwardly through said head and having a vertical series of rack teeth, a pinion mounted in said head and meshing with said rack teeth, said pinion having a shaft journalled in bearing means in said head, and an operating handle connected with said shaft for driving said pinion.

6. A can crusher according to claim 5, wherein the connection of said operating handle with said shaft comprises a reversible pawl and ratchet mechanism so that said shaft and thereby said pinion and said rack bar plunger and said ram are adapted to be selectively driven in respectively opposite directions by pumping said operating handle.

7. A can crusher according to claim 6, including anti-back lash means carried by said head and acting on said rack bar plunger.

8. A can crusher according to claim 7, wherein said anti-back lash means comprises a pressure pad means and means for adjusting the pressure pad means.

9. A can crusher according to claim 1, including base means supporting said worktable at an elevation greater than the thickness of a crushed can disk slug discharged from said receptacle.

10. A can crusher according to claim 9, wherein said worktable comprises a plate, and said means for supporting the worktable plate comprises a base plate and spacer means supporting said worktable plate on said base plate.

11. A can crusher according to claim 1, wherein said means for vertically actuating the ram comprises an elongate plunger member which projects upwardly from said head, and a combination guard sheath and handle mounted on said head and extending upwardly about said plunger member.

12. A can crusher according to claim 1, including a base supporting said standard, and means securing said standard to said base releasably so that adjustments of the standard can be made for accommodating different sizes of cans to be crushed.

* * * * *